US007344102B1

(12) United States Patent
Royer et al.

(10) Patent No.: US 7,344,102 B1
(45) Date of Patent: Mar. 18, 2008

(54) METHOD AND APPARATUS FOR VARIABLE TENSION CORD RECOIL AND TETHERED USER INTERFACE

(75) Inventors: Joel D. Royer, Fullerton, CA (US); Rene L. Barba, Chino Hills, CA (US); Douglas J. Wolfe, Chino Hills, CA (US); Steve C. Olauson, Alta Loma, CA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 275 days.

(21) Appl. No.: 10/878,701

(22) Filed: Jun. 28, 2004

(51) Int. Cl.
*B65H 75/48* (2006.01)

(52) U.S. Cl. ..... 242/373; 267/273; 267/275; 267/281; 267/284; 267/254; 267/255

(58) Field of Classification Search ..... 242/373; 267/154, 156–157, 273, 275, 281, 284, 254, 267/255
See application file for complete search history.

(56) References Cited

U.S. PATENT DOCUMENTS 4,084,764 A * 4/1978 Mogerlein et al. ..... 242/373
4,171,109 A * 10/1979 Roe ..... 242/375
6,845,736 B1 * 1/2005 Anderson ..... 119/796

FOREIGN PATENT DOCUMENTS

JP 63130938 A * 6/1988

* cited by examiner

*Primary Examiner*—Peter M. Cuomo
*Assistant Examiner*—Sang Kim
(74) *Attorney, Agent, or Firm*—Nathan O. Jensen; Kyle Eppele

(57) ABSTRACT

Variable tension is applied to a cord as it is drawn from a spool. More tension is applied to the cord as more cord is drawn preventing impulse stress. Cord used to attach user interface device for receiving input and presenting information.

5 Claims, 7 Drawing Sheets

METHOD AND APPARATUS FOR VARIABLE TENSION CORD RECOIL AND TETHERED USER INTERFACE

FIELD OF THE INVENTION

This invention relates generally to cord recoil mechanisms and tethered user interfaces.

BACKGROUND OF THE INVENTION

Various apparatus have long used a tension-based recoil system that enables a tether or pull cord to be drawn back onto a spool. One of the most common examples of such a device is that of small motor that comprises a "pull-start". A cord is typically wound concentrically about a containment spool. One end of the cord is typically attached proximate to the inner circumference of the containment spool. When the cord is drawn out off of the spool by pulling its free end, the containment spool rotates. This results in rotational work that may then be conveyed to the crankshaft of a small motor by a one-way clutch mechanism. Once the cord has been drawn to the completion of its cycle, a recoil means that is attached to the containment spool cause the spool to rotate in an opposite direction. This causes the cord to be taken back up onto the containment spool.

Another interesting application for a recoil cord mechanism is the use of the mechanism to tether a user interface device. In many applications, electronic systems need to receive input from and/or present information to a user. By tethering the user interface device, it may be stowed when the user does not need to interact with the electronic system. And, in this stowed position, the recoil mechanism draws the electrical cord back onto the spool so that it, too, is kept out of the way.

Irrespective of the application, a cord that may be pulled from a spool is always susceptible to failure. When the cord that is pulled from the spool reaches the end of its cycle, it typically experiences a sudden impulse of tensile force. This tensile force induces a stress-oriented failure. Where the cord is used for electrical connections, as in the user interface application described above, failure may be catastrophic. In other applications, the failure may also be catastrophic, but the wear and tear experienced by the cord is generally visible before an actual failure occurs. In the electrical connection case, failure of the electrical cord that is used to tether a user interface device may not be detectable by visual inspection.

These types of failures are exceptionally common where the application of the recoil mechanism constitutes use by members of the public. One example of this is an on-aircraft, in-flight entertainment (IFE) system. In this example application, airline passengers are typically provided with a user interface device. This user interface device is generally disposed in the airline seat and may be stowed in a cradle when it is not in use by the passenger. Each time a passenger draws the user interface device from the cradle, the electrical cord used to effect a connection to the IFE system is fatigued at the end of the pull cycle; leading to eventual and inevitable failure.

SUMMARY OF THE INVENTION

The present invention comprises a method for dispensing a cord from a spool using variable tension. By applying an increasing amount of pull tension as more cord is drawn from the spool, the cord is prevented from experiencing the sudden tensile stress associated with the end of the pull cycle. To enable this effect, the method of the present invention provides for mounting the spool onto a mounting hub. The mounting hub is typically part of a spool container that is used to mount a spool. According to one method of the present invention, the spool comprises an inner perimeter and a cord take-up channel. By providing a variable spring constant spring that is attached to and spirally wound about the mounting hub and then attached to the inner perimeter of the spool, the method provides for the application of variable tension to a cord that is drawn from the spool. Hence, as the cord is drawn from the spool, a weaker tension is applied to cord in order to allow a user to easily draw the cord from the spool. Toward the end of the pull cycle, the tension is increased in order to ensure that the rate at which the cord is drawn from the spool is reduced. This relieves the sudden impulse of tensile stress that the cord would otherwise experienced once it reaches the end of the pull cycle.

Several derivative methods are taught for providing a variable spring constant spring. One such method is that of providing a flat spring material having a first width at a first end of the material and a second width at the second end of the material. The material is tapered from the first width to the second width providing a variable spring constant once the material is spirally wound about the hub. This method provides a variable spring constant spring wherein the spring constant various constantly according to the amount of cord that is drawn from the spool.

Another method for providing a variable spring constant spring relies on providing a flat spring material wherein the width of the material is formed with a first width at a first end and a second width at a second end. This variation of the inventive method provides for reducing the width from the first width to the second width at a pre-established distance from the first end of the spring material. Typically, this pre-established distance corresponds to the amount of cord that must be pulled from the spool before the amount of tension applied to the cord is increased. A variation of this method provides for imparting a first hardness to a first portion of the spring material and a second hardness to a remaining portion of the spring material; the material exhibits a bifurcation of hardness at the pre-established distance. Both of these variations of the inventive method provide for the application of tension to the cord according to a first spring constant up to a pre-established amount of cord pull distance. Once the amount of cord dispensed from the spool exceeds this pre-established amount, the amount of tension applied to the cord, according to this variation in the method, is dictated by a second spring constant.

The method of the present invention may be varied in order to support the receipt of input from a user or to support presentation of information to a user. Accordingly, this derivative method provides that the cord to be wound about the mounting hub should be an electrical cord. The electrical cord may be attached to a spool proximate to the base of the channel. A user interface device may then be attached to the cord. The method then provides for the receipt of user input for the display of presentation information to the user by way of the electrical cord.

The present method may be embodied in a tethered user interface assembly that also comprises the invention. According to one embodiment of the invention, the tethered user interface assembly comprises a user interface device, a variable tension recoil assembly and an electrical cord that connects the user interface device to the variable tension recoil assembly. In one alternative embodiment of the invention, the tethered user interface assembly further comprises a cradle that may be used to stow the user interface device when it is not in use.

One feature of the illustrated embodiment described herein is the variable tension recoil assembly. The variable tension recoil assembly may comprise a spool container, a spool and a spring. The spool container may comprise a spool mounting hub and a spring attachment point proximate to the spool mounting hub. The spring may be attached to and spirally wound about the mounting hub. The other end of the spring may be attached to a spring attachment point that may comprise a spool. A first end of the electrical cord may then be attached to an electrical cord attachment point that may further comprise the spool. The cord may be wound about the spool and a second end may be attached to the user interface device.

The spring comprising the variable tension recoil assembly may comprise a flat spring material the width of which is tapered from a first width to a second width. According to one alternative embodiment of the present invention, the spring may comprise a flat spring material having a first end and a second end and wherein the width of the material at one end is a first width and is reduced to a second width at a pre-established distance from the first end and remains at this reduced with for the remaining portion of the material's length. In yet another alternative illustrative embodiment of the present invention, the spring material may be imparted with a first hardness from the first end of the material to the pre-established distance from the first end and material. A second hardness, which is of less hardness than the first hardness, the then be imparted remaining portion of the material.

The user interfaces device may comprise an input means for receiving input from a user. The user interface device may also comprises a display means that may be used to present information to a user. In one alternative embodiment of the invention, the user interface device may comprise a credit card reading means that may be used to read a credit card that may be inserted into the reading means by a user.

BRIEF DESCRIPTION OF THE DRAWINGS

The foregoing aspects are better understood from the following detailed description of one embodiment of the invention with reference to the drawings, in which.

DETAILED DESCRIPTION OF THE INVENTION

Figure 1:
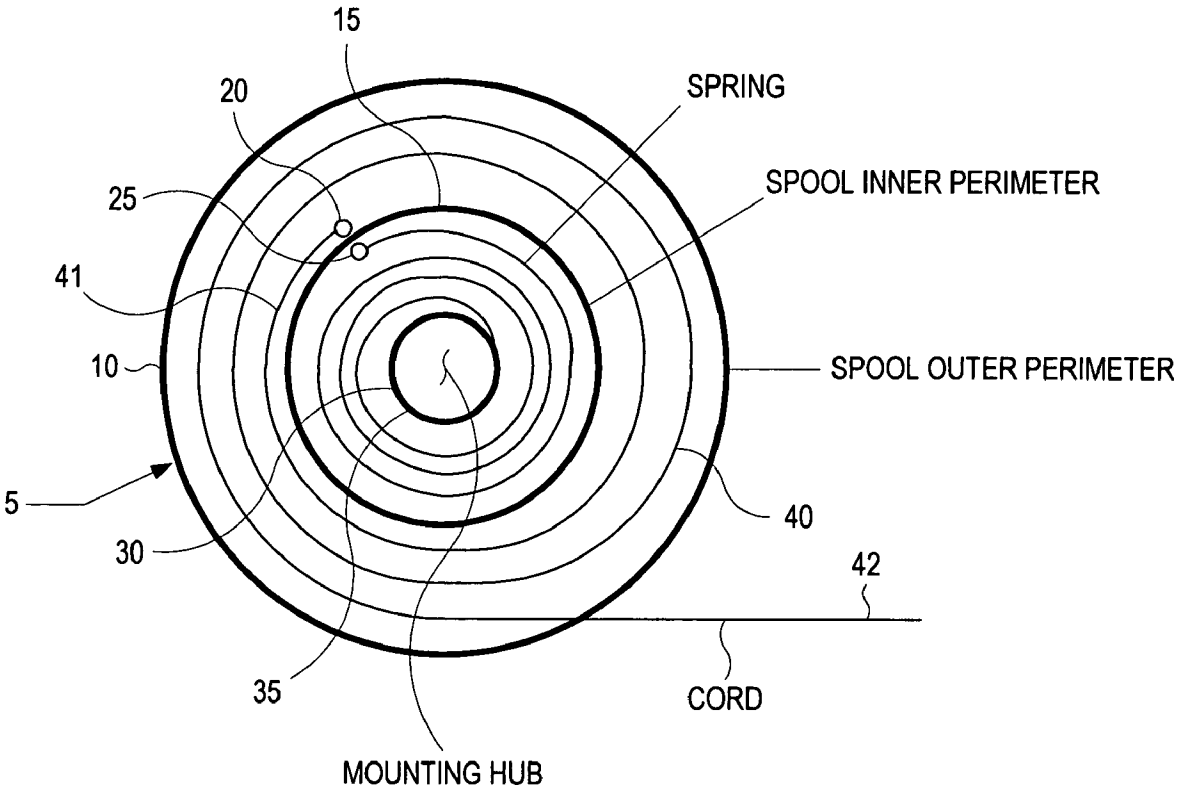
FIG. 1 is a pictorial representation of a recoil mechanism that applies variable tension to a cord according to the present invention.

FIG. 1 is a pictorial representation of a recoil mechanism that applies variable tension to a cord according to the present invention. According to one illustrative embodiment of the present invention, a recoil mechanism may comprise a containment spool 5 that is mounted onto a hub 30. The containment spool typically has an outer perimeter or circumference 10 and an inner perimeter or circumference 15. The inner perimeter 15 of the containment spool typically has an inner surface and an outer surface relative to the center of the spool.

According to this example embodiment, a cord 40 is wrapped spirally about the inner perimeter 15 comprising the containment spool 5. The cord 40 may be attached to an attachment point comprising the containment spool 5. The attachment point 20 is typically disposed proximate to the inner perimeter 15 of the containment spool 5. For the sake of clarity, the cord 40 may have a first end 41 that is typically attached to the attachment point comprising the containment spool 5. The cord 40 also has a second end 42 that is generally referred to as the "free end". The free end of the cord may be attached to a pull handle, as in the case where the present invention is used to start a motor. The free end may also be attached to an electrical device such as a user interface device. These application examples are meant to illustrate some typical uses for the present invention and are not intended to limit its scope.

FIG. 1 further illustrates that the invention comprises a variable spring constant tension spring 35. The variable tension spring 35 typically comprises a first end and a second end. The first end of the variable tension spring may be attached to the mounting hub 30. The variable tension spring 35 is typically wound spirally about the mounting hub 30. The second end of the variable tension spring 35 may then be attached to a spring mounting point comprising the containment spool 15. The spring mounting point comprising the containment spool 15 may be disposed proximate to the inner surface of the inner perimeter 15.

The figure illustrates that both the tension spring 35 and the cord 40 are spirally wound in the same direction about the center of the assembly that comprises the invention. When the invention is assembled, the cord 40 is wound and drawn about the spool in order to place the tension spring 35 into an initial tensile state. Once in this state, the cord 40 may be drawn from the containment spool 5 inducing more tension in the variable tension spring 35.

Figure 2:
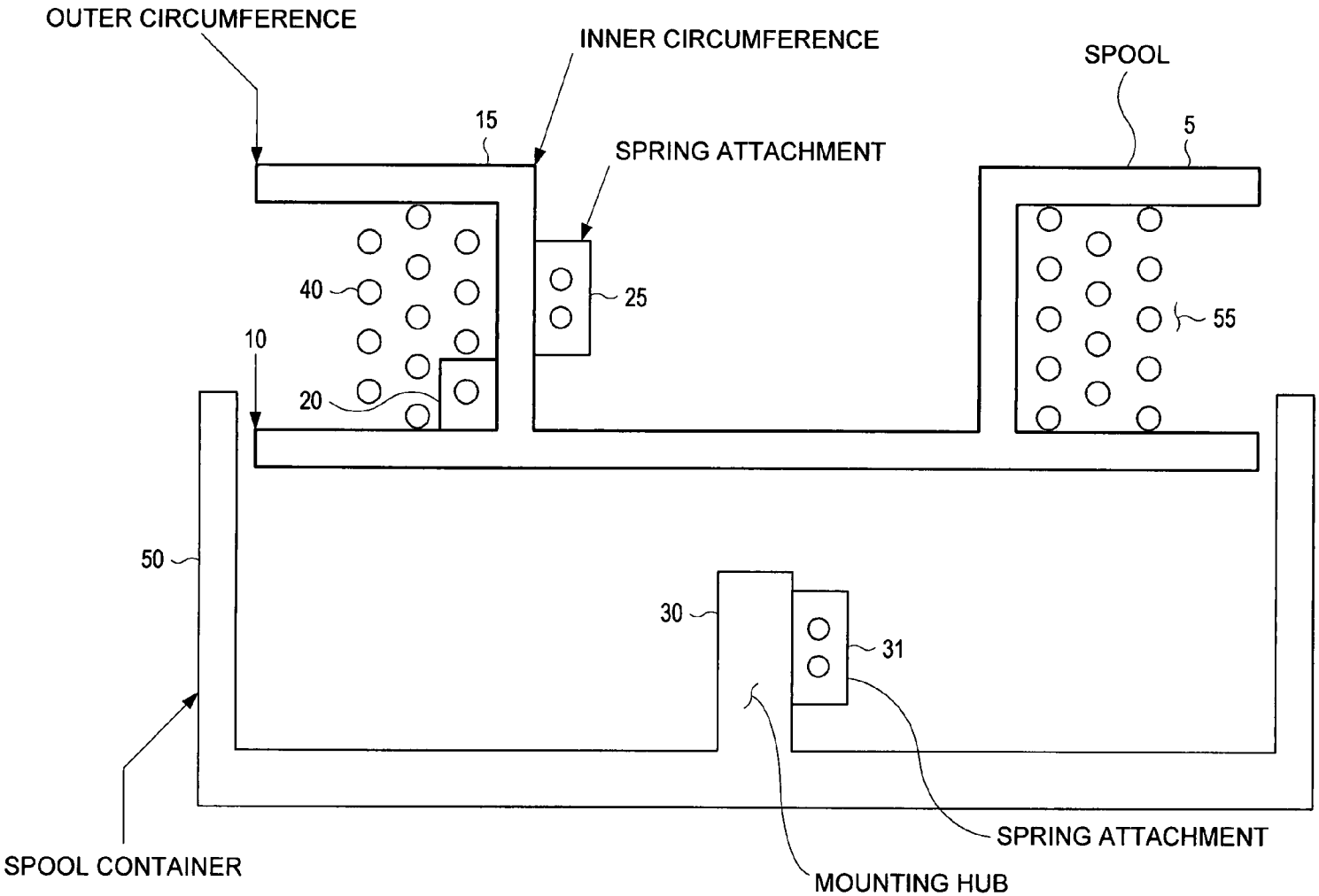
FIG. 2 is a cross sectional view of a recoil assembly comprising a variable tension spring according to the present invention.

FIG. 2 is a cross sectional view of a recoil assembly comprising a variable tension spring according to the present invention. The containment spool 5 of the present invention may comprise a cord channel 55. The cord channel 55 is typically used to contain the cord 40 spirally disposed about the inner perimeter 15 of the containment spool 5. The attachment point 20 that may comprise the containment spool 5 and that is disposed proximate to the outer surface of the inner perimeter 15 of the spool may be used to secure the first end of the cord 40.

Figure 3:
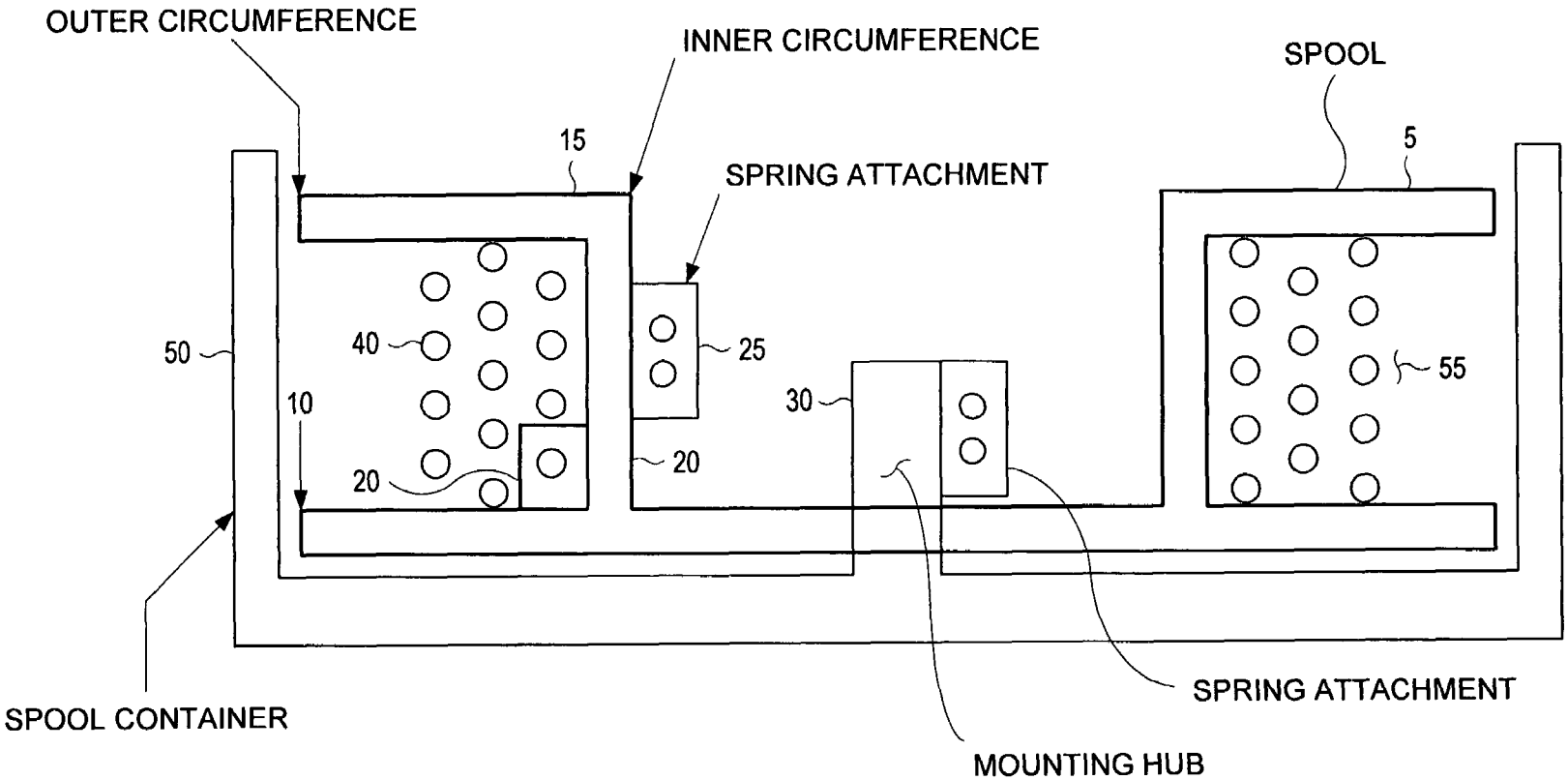
FIG. 3 is also a cross sectional view of a recoil mechanism that depicts the installation of a containment spool onto a hub according to the present invention.

FIG. 3 is also a cross sectional view of a recoil mechanism that depicts the installation of a containment spool onto a hub according to the present invention. Before the variable tension spring 35 may be subjected to an initial tension level, the containment spool may first need to be installed about mounting hub 30. The mounting hub may comprise a spool container 50 that may further comprise the invention. The mounting hub 30 typically comprises an attachment means 31 that is used to secure the first end of the variable tension spring 35.

Figure 4:
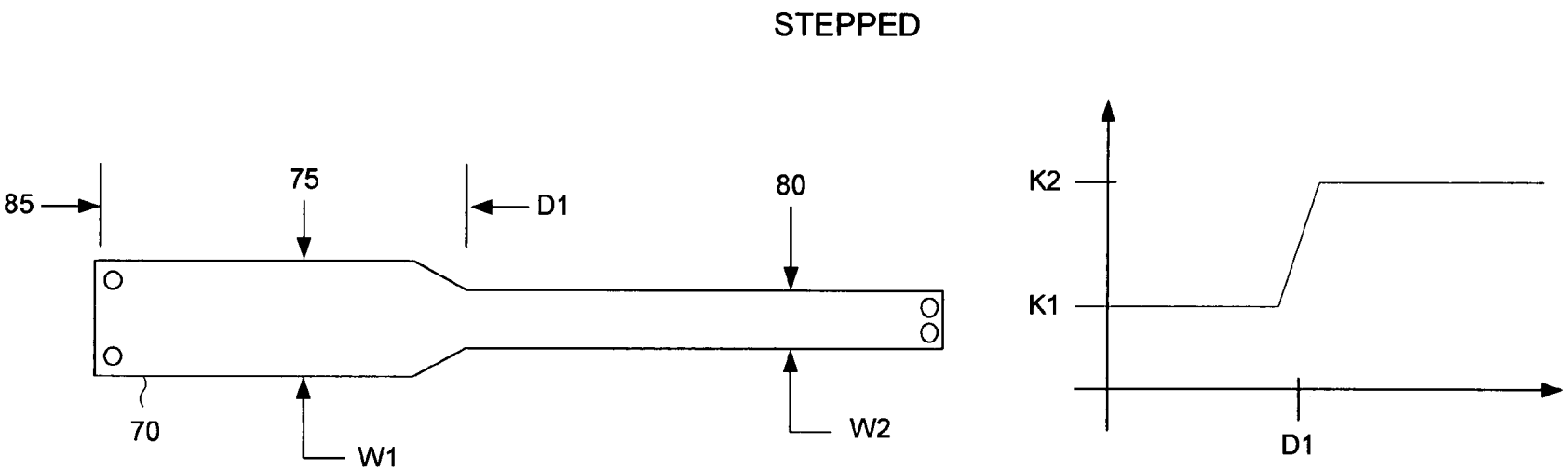
FIG. 4 is a pictorial representation of one possible embodiment of a variable tension spring comprising a stepped spring constant according to the present invention.
Figure 5:
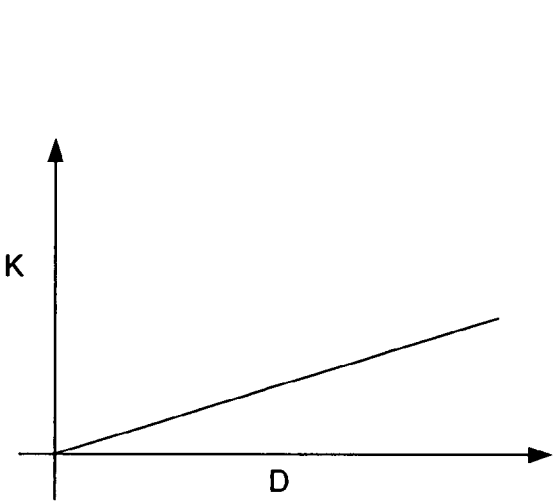
FIG. 5 is a pictorial representation of one example embodiment of a variable tension spring comprising a smoothly variable spring constant according to the present invention.
Figure 5:
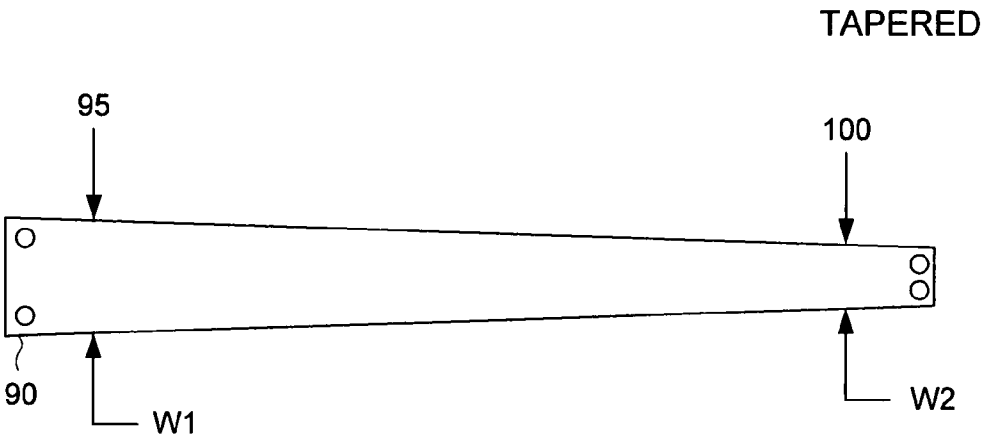

FIG. 4 is a pictorial representation of one possible embodiment of a variable tension spring comprising a stepped spring constant according to the present invention. The spring 35 that may be spirally disposed about the mounting hub may be manufactured by providing a flat spring material 70. The flat spring material 70 may have a first end and a second end. At some pre-established distance from the first end $D_1$ (85), the width of the spring material 70 may be reduced from a first width $W_1$ (75) to a second with $W_2$ (80). This results in a greater spring constant in the first portion of the spring proximate to the first end. In operation, as a cord is drawn from the containment spool 5, it is initially subject to the lesser spring constant associated with the reduced width of the spring material in the second portion of the spring proximate to the second end. As the cord is drawn beyond the pre-established distance, it is then subject to a greater tensile force because the higher spring constant associated with the first portion of the spring 35. This spring configuration results in a stepped spring constant, k, as the amount of cord drawn from the spool exceeds the pre-established distance $D_1$ (85), FIG. 5 is a pictorial representation of one example embodiment of a variable tension spring comprising a smoothly variable spring constant according to the present invention. Where the first embodiment of a variable tension spring according to FIG. 4 provides a stepped spring constant response, a smoother variation in spring constant, k, may be achieved by forming the spring 35 from a flat spring material 90 and then tapering the width of the material from a first width 95 down to a second width 100. According to this embodiment, the tension that may be applied to a cord varies according to a variable spring constant inversely proportional to the width of the spring at any point of draw of the cord 40 from the containment spool 5.

Figure 6:
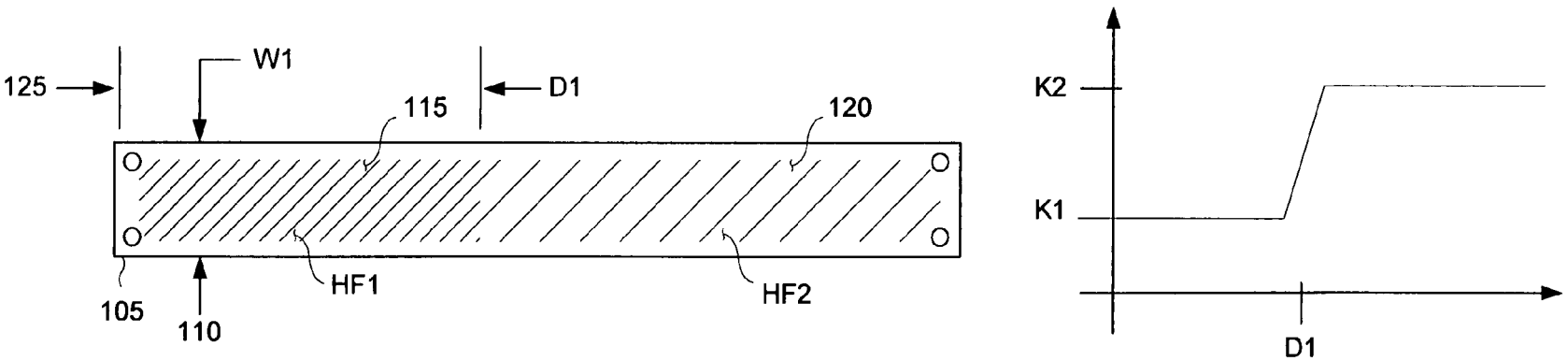
FIG. 6 is a pictorial representation of an alternative embodiment of a stepped spring constant, variable tension spring according to the present invention.

FIG. 6 is a pictorial representation of an alternative embodiment of a stepped spring constant, variable tension spring according to the present invention. According to this example embodiment of the present invention, the variable spring tension spring 35 that comprises the invention may be formed from a flat spring material 105 having a first end and a second end. The flat spring material may be imparted with a first hardness 115 from the first end of the material 105 to substantially to a pre-established distance D1 (125) from the first end. The flat spring material 105 may also be imparted with a second hardness 120 that is less than the first hardness for the remaining portion of the material length. This also results in a variable tension spring that exhibits a stepped spring constant, k. In the case of a metal spring material, different hardness factors may be imparted to the material by varying the amount or intensity of heat-treating the material.

Figure 7:
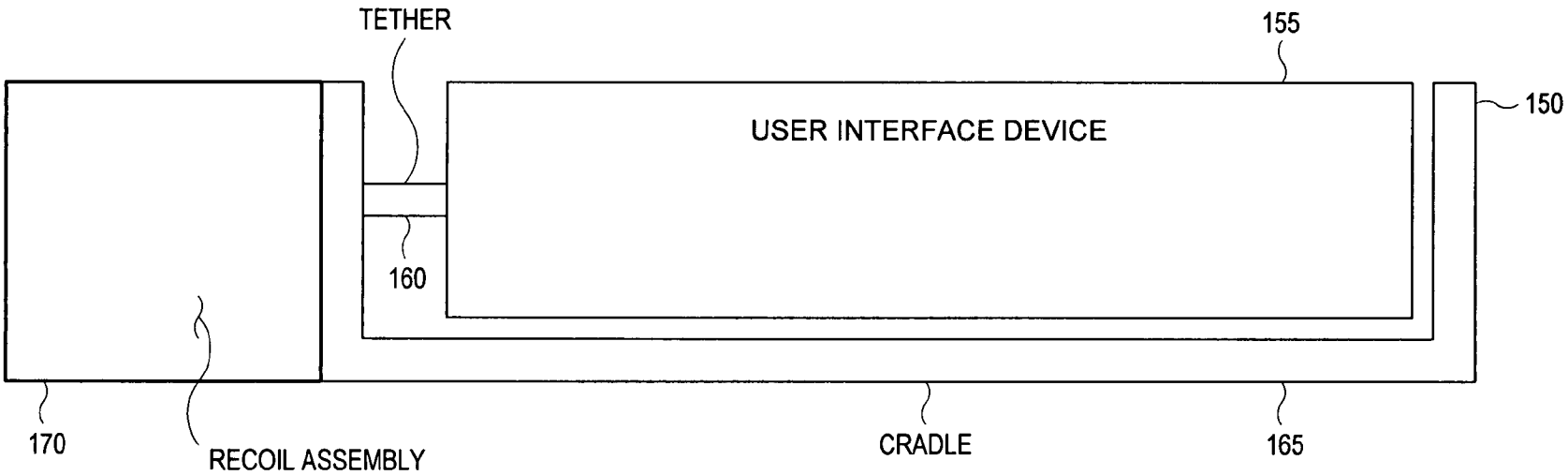
FIG. 7 is a pictorial representation of a tethered user interface assembly comprising the variable tension recoil assembly according to the present invention.

FIG. 7 is a pictorial representation of a tethered user interface assembly comprising the variable tension recoil assembly according to the present invention. This illustrated embodiment of the present invention comprises a recoil assembly 170, a user interface device 155 and a tether 160 for connecting the user interface device 155 to the recoil assembly 170. The tether generally comprises an electrical cord. According to one alternative embodiment of the invention, the tethered user interface assembly may further comprise a cradle 165 that may be used to stow the user interface device when it is not in use. The cradle may comprise a cavity is integrally molded or machined into a housing that may comprise the tethered user interface assembly and may be attached to the recoil mechanism.

According to one alternative embodiment of the present invention, the variable tension recoil assembly 170 may comprises a spool container, a spool that is mounted in the spool container and a spring. The spool container may comprise a spool mounting and a spring attachment point proximate to the spool mounting. The spool may comprise an electrical cord attachment point and a spring attachment point. Commensurate with the teachings of the present invention, the first end of the spring is attached to the spring attachment point comprising the spool container and a spring of may then be bound about the mounting. A second end of the spring may then be attached to spring attachment point comprising the spool. The electrical cord may be attached to the electrical cord attachment point and then wound about the spool.

According to one alternative embodiment of the present invention, the spring may comprise a flat material the width of which is tapered from a first width to a second width from substantially a first end of the material to a second end of the material. Alternatively, the spring material may comprise a first width from substantially a first end of the material to substantially a pre-established distance from the first end of the material. The width of the spring material may then be reduced to a second width for the remaining portion of the length of the spring material. In yet another alternative embodiment of the present invention, spring material may comprise a first hardness factor from substantially a first end of the material to substantially a pre-established distance from the first end of material. The remaining length of the material may comprise a second hardness factor. Typically, the second hardness factor provides less hardness than the first hardness factor.

The user interface device, according to one alternative embodiment of the present invention, may comprise input means for receiving input from a user. Such input means may comprise a pushbutton that is monitored by electrical circuitry comprising the user interface device. This electrical circuitry may then dispatch an indication that the pushbutton has been actuated by a user. This may then be conveyed by way of the electrical cord, through the recoil assembly and ultimately to an electrical system such as an IFE system. It should be noted that the scope of the present invention is not intended to be limited to this one example application.

Another alternative embodiment of this invention provides the user interface device comprise a display means. The display means may be used to present information or status to user from an electrical system such as an IFE system. Again, the scope of the present invention is not intended to be limited to IFE system applications. The display means may comprises a light emitting diode (LED). The LED may be driven by an electrical signal received by way of the electrical cord dispensed from the recoil mechanism. The electrical cord typically receives the electrical signal from an electrical system. An IFE system is just one example of an electrical system that may drive the electrical signal to stimulate the LED and is not intended to limit the scope of the present invention. Alternatively, the display means may comprise a graphical display. The graphical display may be used to display textual or graphical information to a user. The graphical display may comprise a liquid crystal display device that may be driven by electrical circuitry comprising the user interface device.

In some applications, one alternative embodiment of a user interface device may comprise a credit card reading means. Typically, the credit card reading means may comprise a credit card reader that is controlled by electrical circuitry that may further comprise the user interface device.

When a user "swipes" the credit card through the credit card reader, the electrical circuitry may read information from a magnetic stripe comprising the credit card and convey this back to an electrical system by way of the electrical cord dispensed by the recoil mechanism. Again, an IFE system is just one example of an electrical system that may receive credit card information from the user interface device by way of the electrical cord dispensed by the recoil mechanism. This one example application is not meant to limit the scope of the present invention.

In order to further clarify the present invention, it should be noted that the tethered user interface assembly embodies a method for dispensing a cord from a spool comprising the steps of providing a spool, a spool container comprising a mounting hub and providing a variable spring constant spring. Typically, this method provides for attaching the cord to spool. In most variations of this method, the spool may comprise a take-up channel and will have an inner perimeter. The spool may further comprise an attachment point for attaching the variable spring constant spring.

According to this method, the cord may be wound onto the spool once it is attached thereto. The spool may be mounted onto the spool mounting hub. The spring may be attached to the attachment point comprising the spool and may also be attached to the spool mounting hub. The present method then provides for applying a variable tension to the cord as the cord is drawn from the spool. Generally, the tension applied to the board will vary according to the amount of cord that is drawn from the spool.

Providing a spring may be accomplished by providing a flat spring material and then tapering the width of the spring material from a first width to a second width substantially from the first end to the second end of the flat spring material.

According to one derivative method of the present invention, application of variable tension to the cord as the cord is drawn may be done according to a first spring constant as the cord is drawn from the spool up to a first pre-established amount. Once the cord has been drawn from the spool by this amount, tension may be applied to the cord according to a second spring constant. One alternative to this method provides that a spring may be provided by providing a flat spring material. The flat spring material may have a first width. The width of the flat spring material may then be reduced to a second width from a point that is substantially a pre-established distance from one end of the flat spring material. This pre-established distance typically corresponds to the amount of cord that must be drawn from the spool before a second spring constant is used to control the tension applied to cord.

One additional variation of this method provides that the flat spring material may be provided and then imparted with two different hardness factors. The first hardness factor, which is typically greater than a second hardness factor, may be imparted to the flat spring material up to a pre-established distance from one end of the flat spring material. The pre-established distance may typically correspond to be mounted cord that must be drawn from the school before the tension applied to the cord is controlled by a second spring constant. The remaining portion of the flat spring material is then imparted with a second hardness factor.

This method may be further modified by providing an electrical cord that is wound about the spool. This modified method may then provide for receiving user input from a user interface device or presenting information on the user interface device by way of the electrical cord.

ALTERNATIVE EMBODIMENTS

While this invention has been described in terms of several preferred embodiments, it is contemplated that alternatives, modifications, permutations, and equivalents thereof will become apparent to those skilled in the art upon a reading of the specification and study of the drawings. It is therefore intended that the true spirit and scope of the present invention include all such alternatives, modifications, permutations, and equivalents.

What is claimed is:

1. A method for dispensing a cord having a first and second end from a spool comprising the steps of:

providing a spool container comprising a spool mounting hub;

providing a spool comprising an inner perimeter and a cord take-up channel;

providing the variable spring constant spring wherein the step of providing a variable spring constant spring comprises the steps of:

providing a single piece of flat spring material having an overall length, a first width, a first free end and an opposing second free end and a continuously tapered width to a second width from substantially the first free end to the second free end;

attaching the cord to the spool proximate to the base of the channel;

winding the cord onto the spool;

mounting the spool onto the spool mounting hub;

attaching a first one of the first free end and the second free end, to an attachment point proximate to the inner perimeter of said spool;

attaching a second one of the first free end and the second free end comprising said spring to the spool mounting hub; and applying a variable tension to the cord as the cord is drawn from the spool wherein the tension applied to the cord varies according to the amount of cord that is drawn from the spool.

2. The method of claim 1 wherein the step of applying a variable tension to the cord as the cord is drawn from the spool comprises the steps of:

applying tension to the cord according to a first spring constant as the cord is drawn from the spool up to a first pre-established amount; and applying tension to the cord according to a second spring constant as the cord is drawn from the spool from the first pre-established amount up to a second pre-established amount.

3. The method of claim 1 wherein the step of providing the spring comprises the steps of:

providing the flat spring material having an overall length, a first overall width, the first end and the second end; and reducing the width of the flat spring material to the second width from substantially a pre-established distance corresponding to the pre-established amount of cord that may be drawn from the spool at a first spring constant tension from the first end to the second end of the flat spring material.

4. The method of claim 1 wherein the step of providing the spring comprises the steps of:

providing the flat spring material having an overall length, an overall width, the first end and the second end;

imparting a first hardness to the flat spring material from the first end to substantially a pre-established distance corresponding to the pre-established amount of cord that may be drawn from the spool at a first spring constant tension; and imparting a second hardness that is less than the first hardness to the flat spring material from substantially a pre-established distance corresponding to the pre-established amount of cord that is drawn from the spool at a first spring constant tension from the first end to the second end of the flat spring material.

5. The method of claim 1 wherein the continuously tapered width is a continuously and linearly tapered width.

* * * * *